United States Patent [19]

Pillsbury

[11] Patent Number: 4,726,181

[45] Date of Patent: Feb. 23, 1988

[54] METHOD OF REDUCING NOX EMISSIONS FROM A STATIONARY COMBUSTION TURBINE

[75] Inventor: Paul W. Pillsbury, Nether Providence, Pa.

[73] Assignee: Westinghouse Electric Corp., Pittsburgh, Pa.

[21] Appl. No.: 30,002

[22] Filed: Mar. 23, 1987

[51] Int. Cl.[4] ..... F02C 3/14

[52] U.S. Cl. ..... 60/39.06; 60/723; 431/7

[58] Field of Search ..... 60/39.02, 39.06, 723, 60/732, 733; 431/7, 328

[56] References Cited

U.S. PATENT DOCUMENTS

| | | | |
|---|---|---|---|
| 3,832,122 | 8/1974 | La Haye et al. | 431/10 |
| 3,846,979 | 11/1974 | Pfefferle | 60/39.04 |
| 3,928,961 | 12/1975 | Pfefferle | 60/39.02 |
| 3,943,705 | 3/1976 | De Corso et al. | 60/39.74 |
| 3,982,879 | 9/1976 | Pfefferle | 60/39.06 |
| 4,072,007 | 2/1978 | Sanday | 60/39.69 A |
| 4,112,675 | 9/1978 | Pillsbury et al. | 60/39.06 |
| 4,118,171 | 10/1978 | Flanagan et al. | 60/723 |
| 4,197,701 | 4/1980 | Boyum | 431/7 |
| 4,202,168 | 5/1980 | Acheson et al. | 60/39.06 |
| 4,202,169 | 5/1980 | Acheson et al. | 60/39.12 |
| 4,245,980 | 1/1981 | Reed et al. | 431/182 |
| 4,285,193 | 8/1981 | Shaw et al. | 60/39.06 |
| 4,289,474 | 9/1981 | Honda et al. | 431/10 |
| 4,354,821 | 10/1982 | Kesselring et al. | 431/7 |
| 4,413,470 | 11/1983 | Schelhing et al. | 60/39.32 |

FOREIGN PATENT DOCUMENTS

| | | |
|---|---|---|
| 1169257 | 6/1984 | Canada . |
| 1179157 | 12/1984 | Canada . |
| 0000231 | 1/1979 | Japan . |
| 8001737 | 7/1981 | PCT Int'l. Appl. . |

OTHER PUBLICATIONS

EPRI Report No. AP-2584, Oct. 1982, entitled "Stationary Gas Turbine Catalytic Combustor Development Program", prepared by Westinghouse Electric Corporation.

*Primary Examiner*—Louis J. Casaregola
*Attorney, Agent, or Firm*—R. A. Stoltz

[57] ABSTRACT

Hydrocarbon fuel is combusted in a combustion turbine by a method which produces $NO_x$ emmissions below an ultra-low standard. In the method, first, a mix of hydrocarbon fuel and air in a primary flow thereof is burned in a primary combustion zone so as to produce a flow of hot gas of a temperature above that required for an efficient catalytic reaction and which contains $NO_x$ at levels below a low standard but above the ultra-low standard. Next, the hot gas is mixed with hydrocarbon fuel in a secondary flow thereof in a mixing and vaporization zone to provide a flow of heated fuel mixture of a temperature above that required for an efficient catalytic reaction. Thereafter, the heated fuel mixture is inefficiently catalytically reacted in a first catalytic element fuel to provide a flow of effluent gas of a temperature above that required for an efficient catalytic reaction and which contains $NO_x$ at levels below the ultra-low standard and CO and unburned hydrocarbons (UHC) at levels above an acceptable standard. Then, the CO and UHC in the effluent gas flow is mixed in a mixing completion zone to produce a flow of heated mixed effluent gas of a temperature above that required for an efficient catalytic reaction. Finally, the heated mixed effluent gas is efficiently catalytically oxidized in a second catalytic element to provide a flow of exhaust gas having emissions which contains $NO_x$ at levels below the ultra-low standard and CO and UHC at levels below the acceptable standard.

6 Claims, 3 Drawing Figures

METHOD OF REDUCING NOX EMISSIONS FROM A STATIONARY COMBUSTION TURBINE

CROSS REFERENCE TO RELATED APPLICATION

Reference is hereby made to the following copending application dealing with related subject matter and assigned to the assignee of the present invention: "Passively Cooled Catalytic Combustor for a Stationary Combustion Turbine" by W. E. Young et al, assigned U.S. Ser. No. 092,848 and filed 8/24/87.

BACKGROUND OF THE INVENTION

1. Field of the Invention

The present invention relates generally to stationary combustion turbines and, more particularly, is concerned with a method of reducing emissions of mitrogen oxides ($NO_x$) therefrom by employing serially-arranged catalytic combustors therein and operating the upstream one inefficiently and the downstream one efficiently.

2. Description of the Prior Art

In the operation of a conventional combustion turbine, intake air from the atmosphere is compressed and heated by rotary action of a multi-vaned compressor component and caused to flow to a plurality of combustor components where fuel is mixed with the compressed air and the mixture ignited and burned. The heat energy thus released then flows in the combustion gases to the turbine component where it is converted into rotary energy for driving equipment, such as for generating electrical power or for running industrial processes. The combustion gases are finally exhausted from the turbine component back to the atmosphere.

Various schemes have been explored to adapt combustion turbines for the aforementioned uses without exceeding $NO_x$ emission limits. The use of catalytic combustion is a promising approach because it can occur at about 2300 to 2500 degrees F. to produce a high turbine inlet temperature for turbine operating efficiency without any significant side effect $NO_x$ generation from reactions between nitrogen and oxygen which occur at temperatures over 3000 degrees F. In contrast, conventional flame combustion at about 4500 degrees F results in $NO_x$ generation which typically exceeds the limits set in more restrictive areas such as Calif.

Representative of prior art catalytic combustor arrangements for use with a combustion turbine are those disclosed in U.S. Pat. Nos. (3,846,979 and 3,928,961), to Pfefferle (3,943,705), DeCorso et al (4,072,007), Sanday (4,112,675), Pillsbury et al (4,285,193), Shaw et al and (4,413,470); Scheihing et al and Canadian Pat. Nos. 1,169,257 and 1,179,157.

The one catalytic combustion system for a combustion turbine, having the design disclosed in above-cited Canadian Pat. No. 1,169,257, may produce 20 ppmv exhaust emissions of $NO_x$ due to its employment of a non-catalytic burner in series with the catalytic element. Although this meets the Environmental Protection Agency (EPA) standard of 75 ppmv, there are certain areas, such as Japan, that require $NO_x$ emissions as low as 6 ppmv which cannot be met by the design of the above-referenced patent application.

Consequently, a need still exists for a technique to achieve even lower combustion turbine $NO_x$ emissions so as to satisfy even more stringent environmental regulations of certain jurisdictions.

SUMMARY OF THE INVENTION

The present invention provides a $NO_x$ emissions reduction method designed to satisfy the aforementioned needs. The method of the present invention for reducing emissions of nitrogen oxides ($NO_x$) from a combustion turbine provides the steps of employing serially-arranged spaced-apart catalytic elements or combustors in the combustor component of the turbine and operating the upstream one of the catalytic combustors inefficiently and the downstream one efficiently. By operating the upstream catalytic combustor inefficiently, such as at only 74.8% rather than 99.9% which would be normal, the $NO_x$ produced by the preburner in the combustor component is chemically reduced, and the products of the inefficient combustion are then oxidized by the efficiently-operated downstream catalytic combustor. Although there are various techniques to assure that the upstream catalytic combustor operates inefficiently, a preferred approach is to so shorten the axial length of the upstream combustor that there is inadequate residence time for oxidation to be complete.

Accordingly, the present invention is directed to a method of combusting fuel, such as in a combustor component of a combustion turbine, for producing $NO_x$ emissions below a predetermined ultra-low standard, such as 6 ppmv. The method comprises the steps of: (a) combusting in a primary combustion zone a mix of hydrocarbon fuel and air in a primary flow thereof so as to produce a flow of hot gas of temperature above that required for an efficient catalytic reaction and which contains $NO_x$ at levels below a predetermined low standard but above the predetermined ultra-low standard; (b) mixing in a mixing and vaporization zone located downstream of the primary combustion zone a hydrocarbon fuel in a secondary flow thereof with the flow of hot gas to provide a flow of heated fuel mixture of a temperature above that required for efficient catalytic reaction; (c) inefficiently catalytically reacting in a first catalytic element located downstream of the mixing and vaporization zone the heated fuel mixture in the flow thereof to provide a flow of effluent gas of a temperature above that required for efficient catalytic reaction which contains $NO_x$ at levels below the predetermined ultra-low standard and CO and unburned hydrocarbons (UHC) at levels above a predetermined acceptable standard; (d) mixing in a mixing completion zone located downstream of the first catalytic element the CO and UHC in the effluent gas flow to produce a flow of heated mixed effluent gas of a temperature above that required for efficient catalytic reaction; and (e) efficiently catalytically reacting in a second catalytic element located downstream of the mixing completion zone the heated mixed effluent gas in the flow thereof to provide a flow of exhaust gas having emissions which contains $NO_x$ at levels below the predetermined ultra-low standard and C and UHC at levels below the predetermined acceptable standard.

More particularly, the combusting of the hydrocarbon fuel and air in the primary flow thereof is performed by use of a conventional flame. Further, the heated fuel mixture in the flow thereof is resident within the mixing and vaporization zone an insufficient amount of time to allow full vaporization of the fuel in the mixture. Also, the first catalytic element inefficiently operates because it has a shorter length than required for efficient operation.

These and other advantages and attainments of the present invention will become apparent to those skilled in the art upon a readking of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
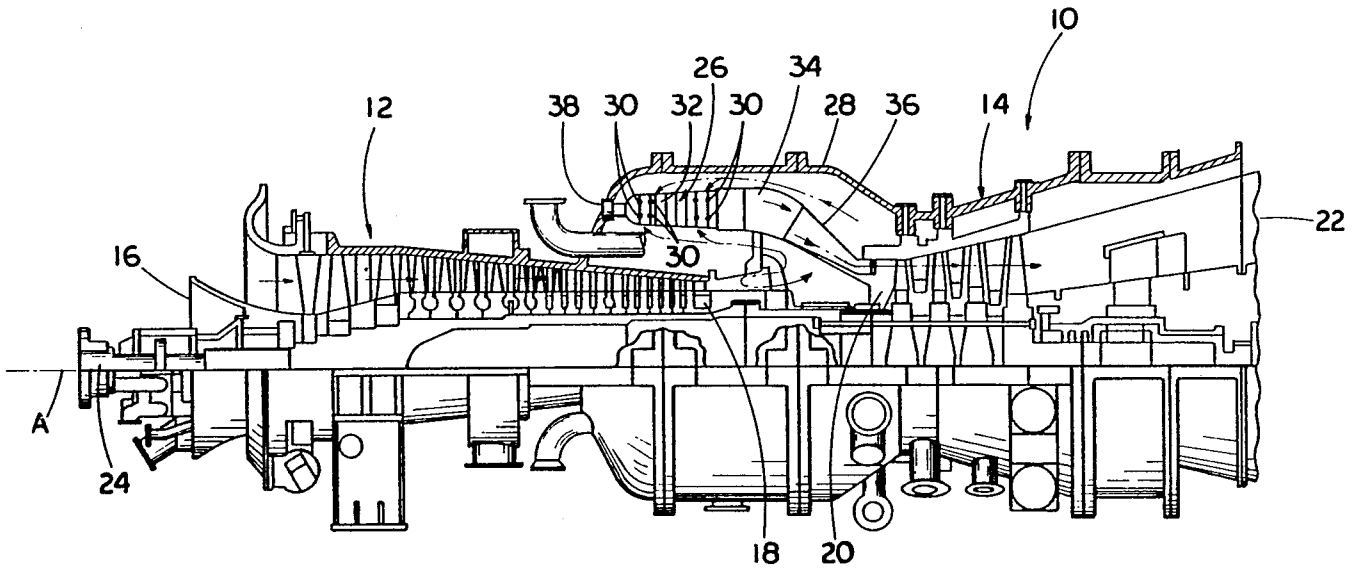
FIG. 1 is a cutaway side elevational detailed view of a conventional stationary combustion turbine.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

Referring now to the drawings, and particularly to FIG. 1, there is illustrated in detail a conventional combustion turbine 10 of the type used for driving equipment (not shown) for generating electrical power or for running industrial processes. The particular turbine of the illustrated embodiment is Westinghouse model W501D, a 92 megawatt combustion turbine. The combustion turbine 10 basically includes a multi-vaned compressor component 12 and a multi-vaned turbine component 14. The compressor and turbine components 12,14 both have opposite inlet and outlet ends 16,18 and 20,22 and are mounted on a common rotatable shaft 24 which defines a longitudinal rotational axis A of the turbine 10.

Also, the turbine 10 includes a plurality of hollow elongated combustor components 26, for instance sixteen in number, being spaced circumferentially from one another about the outlet end 18 of the compressor component 12 and radially from the longitudinal axis A of the turbine. The combustor components 26 are housed in a large cylindrical casing 28 which surrounds the compressor component outlet end 18. The casing 28 provides flow communication between the compressor component outlet end 18 and inlet holes 30 in the upstream end portions 32 of the combustor components 26. Each of the downstream ends 34 of the respective combustor components 26 are connected by a hollow transition duct 36 in flow communication with the turbine inlet end 20.

Figure 2:
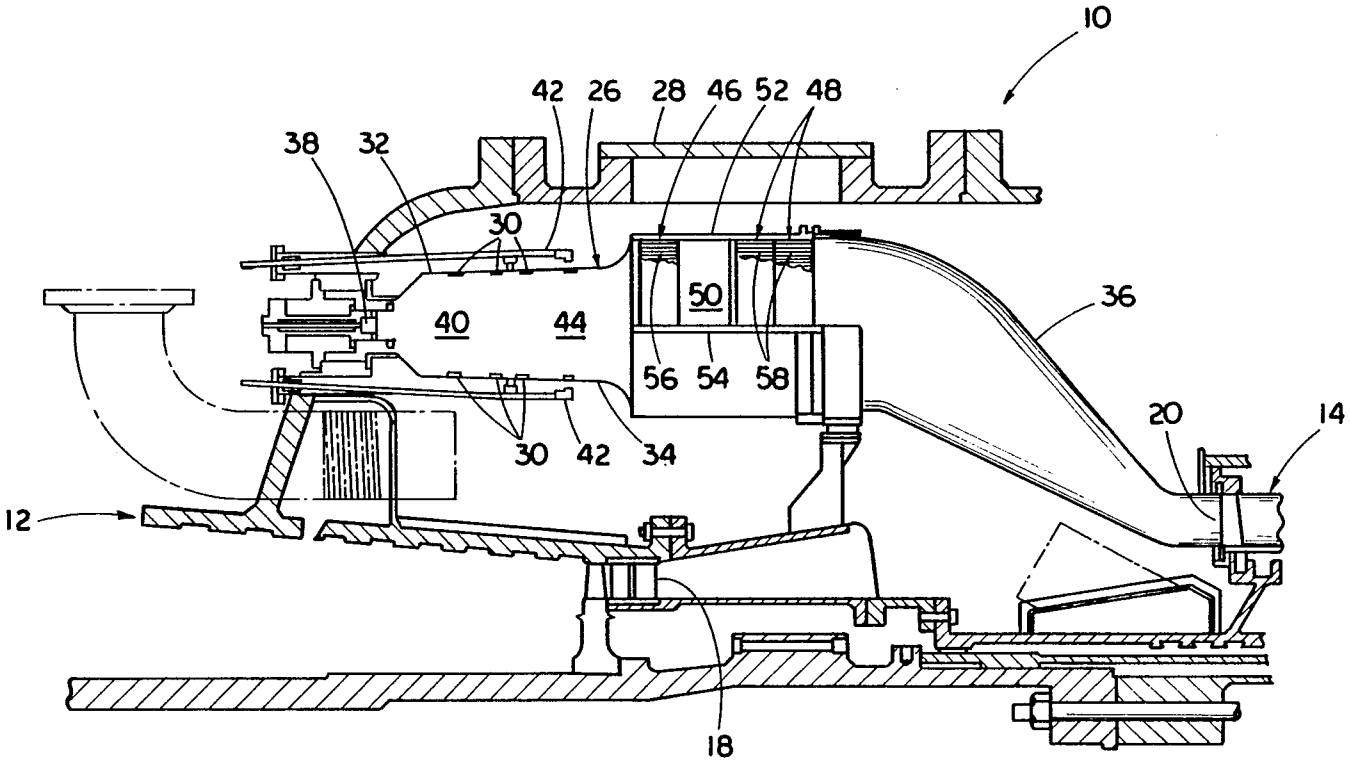
FIG. 2 is an enlarged view, partly in section, of one of the combustors of the turbine of FIG. 1 modified to incorporate a pair of serially-arranged catalytic combustors for operating the turbine in accordance with the principles of the present invention.

Referring also to FIG. 2, a primary fuel nozzle 38 and an igniter (not shown), which generates a small conventional flame (not shown), are provide in communication with a primary combustion zone 40 defined in the interior of the upstream end portion 32 of each combustor component 26. Forwardmost ones of the inlet holes 30 of the respective combustor components 26 provide flow communication between the interior of the casing 28 and the primary combustion zone 40. In addition, a plurality of secondary fuel nozzles 42 are provided along each of the combustor components 26 and align with rearwardmost ones of the inlet holes 30 and a fuel preparation zone 44 located downstream of the primary combustion zone 40.

In the conventional operation of the turbine 10, intake air from the atmosphere is drawn into the compressor component 12 through its inlet end 16, and then compressed and heated therein, by rotational movement of its vanes with the common shaft 24 about the axis A. The compressed and heated air is caused to flow in the direction of the arrows in FIG. 1 through the compressor component 12 and the casing 28 and into the plurality of combustor components 26 through their inlet holes 30 in the upstream end portions 32 thereof.

Hydrocarbon fuel from the primary fuel nozzle 38 flows into the primary combustion zone 40 where it is mixed with the heated and compressed air and the mixture ignited and burned, producing a flow of hot combustion gas. At the fuel preparation zone 44, more hydrocarbon fuel from the secondary fuel nozzles 42 is entrained and burned in the hot gas flow. The heat energy thus released is carried in the combustion gas flow through the inlet end 20 of the turbine component 14 wherein it is converted into rotary energy for driving other equipment, such as for generating electrical power, as well as rotating the compressor component 12 of the turbine 10. The combustion gas is finally exhausted from the outlet end 22 of the turbine component 14 back to the atmosphere.

By employing a pair of upstream and downstream catalytic elements 46,48, spaced apart by a mixing completion zone 50, as seen in FIG. 2, in conjunction with each of the combustor components 26, the turbine 10 can be operated in accordance with the method of the present invention so as to produce a flow of heated exhaust gas flow for driving the turbine component 14 having $NO_x$ emissions below the ultra-low standard of about 6 ppmv. Each catalytic element 46,48 includes a can 52,54 within which a catalytic honeycomb structure 56,58 is conventionally supported by suitable means.

Figure 3:
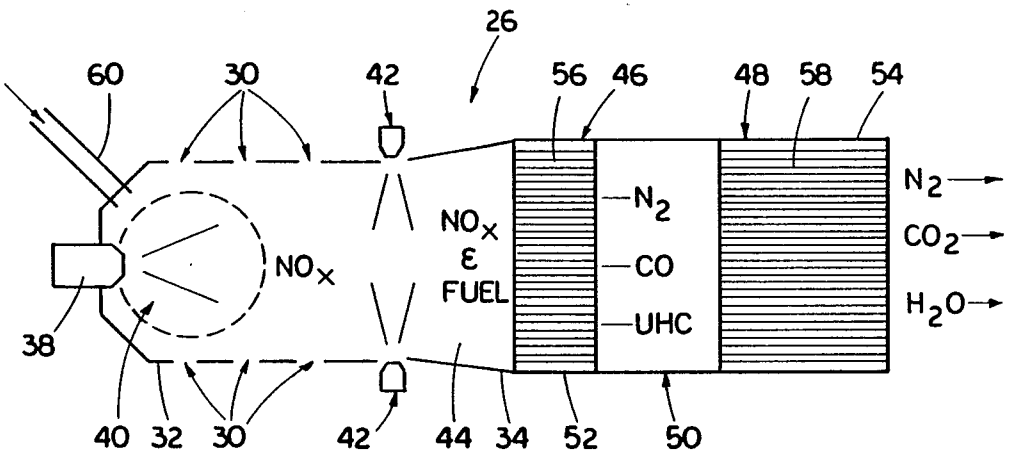
FIG. 3 is a schematic cross-sectional representation of the modified combustor of FIG. 2.

Referring now to FIG. 3, the method of the present invention will now be described. By use of a conventional flame produced by a ignitor 60 in the primary combustion zone 40 of a respective combustor component 26, hydrocarbon fuel and air in a primary flow thereof are mixed, ignited and burned, i.e., combusted, so as to produce a flow of hot gas of a temperature above that required for efficient catalytic reduction (for example 800 degrees F.). The hot gas contains $NO_x$ at levels (for example 28 ppmv) below a predetermined low standard (for example, the EPA standard of 75 ppmv) but above a desired ultra-low standard (for example, 6 ppmv).

The flow of hot gas is then received in the fuel preparation zone 44 (or mixing and vaporization zone) of the combustor component 26, which is located downstream of the primary combustion zone 40. In the fuel preparation zone 44, additional hydrocarbon fuel in a secondary flow thereof injected by the secondary fuel nozzles 42 is mixed with the flow of hot gas. The mixing provides a flow of heated and partially-nonvaporized fuel mixture also of a temperature above that required for an efficient catalytic reaction. The heated fuel mixture is resident within the fuel preparation zone an insufficient amount of time to allow full vaporization of the fuel in the mixture.

The flow of heated and partially-nonvaporized fuel mixture is then received by the upstream catalytic element 46 located downstream of the fuel preparation zone 44. In the upstream catalytic element 46, the heated and partially-nonvaporized fuel mixture is inefficiently catalytically reduced (for example with the element 46 operating at only 74.8% combustion efficiency) to provide a flow of effluent gas of a temperature above that required for efficient catalytic reduction. The effluent gas so produced contains $NO_x$ at levels below the ultra-low standard (for example 6 ppmv) but also contains C and unburned hydrocarbons (UHC) at levels (for example of 2560 ppmv and 4800 ppmv. respectively) above an acceptable standard (for example of 75 ppmv).

The mixing completion zone 50 (for example of 6 inches in length) between the upstream and downstream catalytic elements 46,48 allows mixing of the components ($N_2$, CO and UHC) in the effluent gas flow to produce a flow of heated mixed effluent gas of a temperature again above that required for an efficient catalytic reaction.

The flow of heated and partially-nonvaporized fuel mixture is then received by the downstream catalytic element 48 wherein it is efficiently catalytically oxidized (at 99.9% combustion efficiency which is normal) to provide a flow of heated exhaust gas for the turbine component 14. The exhaust gas has emissions which contain $NO_x$ at levels below the aforementioned ultra-low standard and C and UHC at levels below the aforementioned acceptable standard.

There are various techniques to assure that the upstream catalytic element 46 operates inefficiently. One technique is to so shorten the axial length of the catalytic element 46 so that there is inadequate residence time of the fuel mixture for oxidation or reduction to be complete.

The catalyst characteristics of each element 46,48 can be as follows:

| DATA FOR DXE-442 CATALYST | | |
|---|---|---|
| I. | Substrate | Element 46: |
| | Size | 2 inch thick<br>16 inch in diameter<br>Element 48:<br>(2" + 2") long - (¼" gap between two sections) |
| | Material | Zircon Composite |
| | Bulk Density | 40–42 lb/ft$^3$ |
| | Cell Shape | Corrugated Sinusoid |
| | Number | 256 Channels/in$^2$ |
| | Hydraulic Diameter | 0.0384" |
| | Web Thickness | 10 + 2 mils. |
| | Open Area | 65.5% |
| | Heat Capacity | 0.17 BTU/lb, degrees F. |
| | Thermal Expansion Coefficient | $2.5 \times 10^{-6}$ in/in, degrees F. |
| | Thermal Conductivity | 10 BTU, in/hr, ft$^2$, degrees F. |
| | Melting Temperature | 3050 degrees F. |
| | Crush Strength | |
| | Axial | 800 PSI |
| | 90 | 25 PSI |
| II. | Catalyst | |
| | Active Component | Palladium |
| | Washcoat | Stabilized Alumina |

It is thought that the present invention and many of its attendant advantages will be understood from the foregoing description and it will be apparent that various changes may be made in the form, construction and arrangement of the parts thereof without departing from the spirit and scope of the invention of sacrificing all of its material advantages, the form hereinbefore described being merely a preferred or exemplary embodiment thereof.

I claim:

1. A method of combusting fuel for producing $NO_x$ emissions below a predetermined ultra-low standard, comprising the steps of:

(a) combusting in a primary combustion zone a mix of hydrocarbon fuel and air in a primary flow thereof so as to produce a flow of hot gas of a temperature above that required for an efficient catalytic reaction and which contains $NO_x$ at levels below a predetermined low standard but above the predetermined ultra-low standard;

(b) mixing in a mixing and vaporization zone located downstream of said primary combustion zone a hydrocarbon fuel in a secondary flow thereof with said flow of hot gas to provide a flow of heated fuel mixture of a temperature above that required for an efficient catalytic reaction;

(c) inefficiently catalytically reacting in a first catalytic element located downstream of said mixing and vaporization zone said heated fuel mixture in said flow thereof to provide a flow of effluent gas of a temperature above that required for an efficient catalytic reaction and which contains $NO_x$ at levels below said predetermined ultra-low standard and CO and unburned hydrocarbons (UHC) at levels above a predetermined acceptable standard;

(d) mixing in a mixing completion zone located downstream of said first catalytic element said CO and UHC in said effluent gas flow to produce a flow of heated mixed effluent gas of a temperature above that required for an efficient catalytic reaction; and (e) efficiently catalytically oxidizing in a second catalytic element located downstream of said mixing completion zone said heated mixed effluent gas in said flow thereof to provide a flow of exhaust gas having emissions which contains $NO_x$ at levels below said predetermined ultra-low standard and CO and UHC at levels below said predetermined acceptable standard.

2. The method as recited in claim 1, wherein said combusting is performed by use of a conventional flame.

3. The method as recited in claim 1, wherein said heated fuel mixture in said flow thereof is resident within said mixing and vaporization zone an insufficient amount of time to allow full vaporization of the fuel in said mixture.

4. The method as recited in claim 1, wherein said first catalytic element inefficiently operates by having a shorter length than required for efficient operation.

5. A method of combusting fuel in a combustor component of a combustion turbine for producing $NO_x$ emmissions below a predetermined ultra-low standard, comprising the steps of:

(a) combusting by use of a conventional flame in a primary combustion zone of said combustor component a mix of hydrocarbon fuel and air in a primary flow thereof so as to produce a flow of hot gas of a temperature above that required for an efficient catalytic reaction and which contains $NO_x$ at levels below a predetermined low standard but above the predetermined ultra-low standard;

(b) mixing in a mixing and vaporization zone of said combustor component located downstream of its primary combustion zone a hydrocarbon fuel in a secondary flow thereof with said flow of hot gas to provide a flow of heated partially-nonvaporized fuel mixture of a temperature above that required for an efficient catalytic reaction, said heated fuel mixture in said flow thereof being resident within said mixing and vaporization zone an insufficient amount of time to allow full vaporization of the fuel in said mixture;

(c) inefficiently catalytically reacting in a first catalytic element of said combustor component located downstream of its mixing and vaporization zone said heated partially-nonvaporized fuel mixture in said flow thereof to provide a flow of effluent gas of a temperature above that required for an efficient catalytic reaction and which contains $NO_x$ at levels below said predetermined ultra-low standard and CO and unburned hydrocarbons (UHC) at levels above a predetermined acceptable standard;

(d) mixing in a mixing completion zone of said combustor component located downstream of its first catalytic element said CO and UHC in said effluent gas flow to produce a flow of heated mixed effluent gas of a temperature above that required for an efficient catalytic reaction; and (e) efficiently catalytically oxidizing in a second catalytic element of said combustor component located downstream of its mixing completion zone said heated mixed effluent gas in said flow thereof to provide a flow of heated exhaust gas having emissions which contain $NO_x$ at levels below said predetermined ultra-low standard and CO and UHC at levels below said predetemined acceptable standard.

6. The method as recited in claim 5, wherein said first catalytic element inefficiently operates by having a shorter length than required for efficient operation.

* * * * *